US012379155B2

(12) United States Patent
Sabin et al.

(10) Patent No.: US 12,379,155 B2
(45) Date of Patent: Aug. 5, 2025

(54) ACTUATING SELF-COOLING CAN

(71) Applicant: Tempra Technology, Inc., Bradenton, FL (US)

(72) Inventors: Cullen M. Sabin, Bradenton, FL (US); Alan James Maskell, Grittleton (GB)

(73) Assignee: Tempra Technology, Inc., Bradenton, FL (US)

( * ) Notice: Subject to any disclaimer, the term of this patent is extended or adjusted under 35 U.S.C. 154(b) by 352 days.

(21) Appl. No.: 18/170,029

(22) Filed: Feb. 16, 2023

(65) Prior Publication Data

US 2023/0258399 A1 Aug. 17, 2023

Related U.S. Application Data

(60) Provisional application No. 63/311,126, filed on Feb. 17, 2022.

(51) Int. Cl.
*F25B 17/08* (2006.01)
*F25D 31/00* (2006.01)

(52) U.S. Cl.
CPC ..... *F25D 31/007* (2013.01); *F25B 17/08* (2013.01)

(58) Field of Classification Search
CPC .... F25B 17/08; F25D 2331/805; F25D 3/107; F25D 31/007; F25D 7/00
See application file for complete search history.

(56) References Cited

U.S. PATENT DOCUMENTS 4,669,273 A 6/1987 Fischer et al.
4,759,191 A 7/1988 Thomas et al.
4,901,535 A 2/1990 Sabin
4,949,549 A 8/1990 Steidl et al.
4,993,239 A 2/1991 Steidl et al.
5,018,368 A 5/1991 Steidl
(Continued)

FOREIGN PATENT DOCUMENTS

EP 1155264 4/2005
EP 1155265 4/2008
(Continued)

OTHER PUBLICATIONS

McParland, "Can You Beerlieve It? The New Self-Cooling Beer", http://inventorspot.com/articles/ic_can; r2013; etrieved Feb. 9, 2023.

*Primary Examiner* — Filip Zec
(74) *Attorney, Agent, or Firm* — Sheehan Phinney Bass & Green PA

(57) ABSTRACT

A self-cooling container for cooling a liquid includes a first portion with a first frangible seal that extends across and seals an evaporator unit containing a refrigerant and a second portion with a second frangible seal that extends across and seals a desiccant chamber containing a desiccant. The first portion rotates axially relative to the second portion. An actuator assembly is between the first portion and the second portion and includes: a cutter assembly, which is coupled to the first portion of the self-cooling container and includes a cutter coupled to a rotatable axle and a pinion gear coupled to the rotatable axle, and a drive gear assembly coupled to the second portion of the self-cooling container and including a ring gear supported by a housing. The pinion gear on the cutter assembly is mated to the ring gear of the drive gear assembly.

16 Claims, 9 Drawing Sheets

(56) References Cited

U.S. PATENT DOCUMENTS

| | | | | | |
|---|---|---|---|---|---|
| 5,048,301 | A | | 9/1991 | Sabin | |
| 5,197,032 | A | | 3/1993 | Sabin | |
| 5,626,022 | A | * | 5/1997 | Scudder | A47J 36/28 126/263.01 |
| 5,984,953 | A | * | 11/1999 | Sabin | C09K 5/18 607/108 |
| 6,141,970 | A | * | 11/2000 | Molzahn | F25D 3/107 62/48.2 |
| 6,389,839 | B1 | | 5/2002 | Sabin | |
| 6,513,516 | B2 | | 2/2003 | Sabin | |
| 6,761,042 | B1 | | 7/2004 | Sabin | |
| 6,843,071 | B1 | | 1/2005 | Sabin | |
| 6,889,507 | B1 | | 5/2005 | Clayon et al. | |
| 2008/0017184 | A1 | | 1/2008 | Marshall et al. | |
| 2021/0282587 | A1 | | 9/2021 | Maskell et al. | |

FOREIGN PATENT DOCUMENTS

| | | |
|---|---|---|
| EP | 1100419 | 5/2008 |
| WO | 2003/48654 | 6/2003 |

* cited by examiner

ACTUATING SELF-COOLING CAN

CROSS-REFERENCE TO RELATED APPLICATION

This application claims the benefit of priority to U.S. Provisional Patent Application No. 63/311,126, entitled Method of Actuation for Self-Cooling Beverage Can, which was filed on Feb. 17, 2022. The disclosure of the prior application is incorporated by reference herein in its entirety.

FIELD OF THE INVENTION

This application relates to self-cooling cans and, more particularly, relates to systems and methods for actuating self-cooling cans.

BACKGROUND

Self-cooling cans exist. One example is the I.C. Can™ self-cooling beverage can from Tempra Technology, Inc., the applicant of the current application. The I.C. Can self-cooling beverage can is a beverage can that contains a beverage and has a built-in, self-contained, cooler that is safe, completely functional, environmentally friendly and that operates on the principal of evaporative cooling. When activated, the beverage contained therein is cooled rapidly (e.g., by about 30 degrees Fahrenheit or more in about three minutes or less). This eliminates the need for ice or refrigeration of the beverage and allows consumers to enjoy a cold beverage whenever and wherever they desire. Moreover, the system continues to cool without dilution as the beverage is consumed ensuring that the last drop is as cold or colder than the first.

Improvements are desired, particularly in relation to activating the self-cooling functionalities of a self-cooling cans.

SUMMARY OF THE INVENTION

In one aspect, a self-cooling container for cooling a liquid includes a first portion that includes: a) an internal compartment containing the liquid to be cooled, b) an internal evaporator unit containing a refrigerant, and c) a first frangible seal that extends across and seals off the evaporator unit, and a second portion that includes: a) an internal desiccant chamber containing a desiccant, and b) a second frangible seal that extends across and seals off the desiccant chamber. The first portion is configured to rotate about an axis of the self-cooling container relative to the second portion. An actuator assembly is between the first portion and the second portion of the self-cooling container. The actuator assembly includes a cutter assembly coupled to the first portion of the self-cooling container and a drive gear assembly coupled to the second portion of the self-cooling container. The cutter assembly includes a cutter support, a rotatable axle coupled to the cutter support, a cutter coupled to the rotatable axle, and a pinion gear coupled to the rotatable axle. The drive gear assembly includes a housing and a ring gear supported by the housing. The pinion gear on the cutter assembly is mated to the ring gear of the drive gear assembly.

In another aspect, a self-cooling container for cooling a liquid includes a first portion with a first frangible seal that extends across and seals an evaporator unit containing a refrigerant and a second portion with a second frangible seal that extends across and seals a desiccant chamber containing a desiccant. The first portion rotates axially relative to the second portion. An actuator assembly is between the first portion and the second portion and includes: a cutter assembly, which is coupled to the first portion of the self-cooling container and includes a cutter coupled to a rotatable axle and a pinion gear coupled to the rotatable axle, and a drive gear assembly coupled to the second portion of the self-cooling container and including a ring gear supported by a housing. The pinion gear on the cutter assembly is mated to the ring gear of the drive gear assembly.

In still another aspect, a method of manufacturing a self-cooling container for cooling a liquid is disclosed. The method includes providing a first portion of the self-cooling container. The first portion includes an internal compartment containing the liquid to be cooled, an internal evaporator unit containing a refrigerant, and a first frangible seal that extends across and seals off the evaporator unit. The method further includes providing a second portion of the self-cooling container. The second portion includes an internal desiccant chamber containing a desiccant and a second frangible seal that extends across and seals off the desiccant chamber. The method further includes providing a cutter assembly for the self-cooling container. The cutter assembly includes a cutter support and a rotatable assembly coupled to the cutter support. The rotatable assembly includes a rotatable axle, a cutter coupled to the rotatable axle, and a pinion gear coupled to the rotatable axle. The method further includes providing a drive gear assembly for the self-cooling container. The drive gear assembly includes a housing and a ring gear supported by the housing. The method further includes attaching the cutter support of the cutter assembly to the first portion of the self-cooling container (e.g., with friction and/or an adhesive), attaching the housing of the drive gear assembly to the second portion of the self-cooling container (e.g., with friction and/or an adhesive). The method further includes placing the first portion of the self-cooling container with the attached cutter support in a vacuum chamber, placing the second portion of the self-cooling container with the attached drive gear assembly in the vacuum chamber, establishing a vacuum environment within the vacuum chamber; and pressing the first portion of the self-cooling container with the attached cutter support against the second portion of the self-cooling container with the attached drive gear assembly, with an O-ring therebetween, within the vacuum environment so that the pinion gear of the cutter assembly engages the ring gear of the drive gear assembly. The method further includes removing the first portion of the self-cooling container with the attached cutter support and the second portion of the self-cooling container with the attached drive gear assembly, with the O-ring therebetween, from the vacuum environment. In a typical implementation, the first portion of the self-cooling container with the attached cutter support remains connected to the second portion of the self-cooling container with the attached drive gear assembly after being removed from the vacuum environment by virtue of a low pressure environment persisting in an internal space between the first portion of the self-cooling container and the second portion of the self-cooling container after removal from the vacuum environment.

In some implementations, one or more of the following advantages are present.

For example, the systems and techniques disclosed herein may improve the actuation of self-cooling cans. Some of these improvements may come in the form of increased reliability and effectiveness. Also, the systems and techniques disclosed herein may lead improved to manufacturability of self-cooling cans, and/or actuating systems for self-cooling cans. This may lead to reduced cost, higher efficiencies, improved commercial viability, and scalability of self-cooling cans.

Moreover, some implementations of the systems and techniques disclosed herein protect frangible seals (e.g., foils) in the self-cooling can from undesired damage during assembly, storage, and handling (e.g., prior to activation of the self-cooling can).

Other features and advantages will be apparent from the description and drawings, and from the claims.

BRIEF DESCRIPTION OF THE DRAWINGS

Like reference characters refer to like elements.

DETAILED DESCRIPTION

Figure 9:
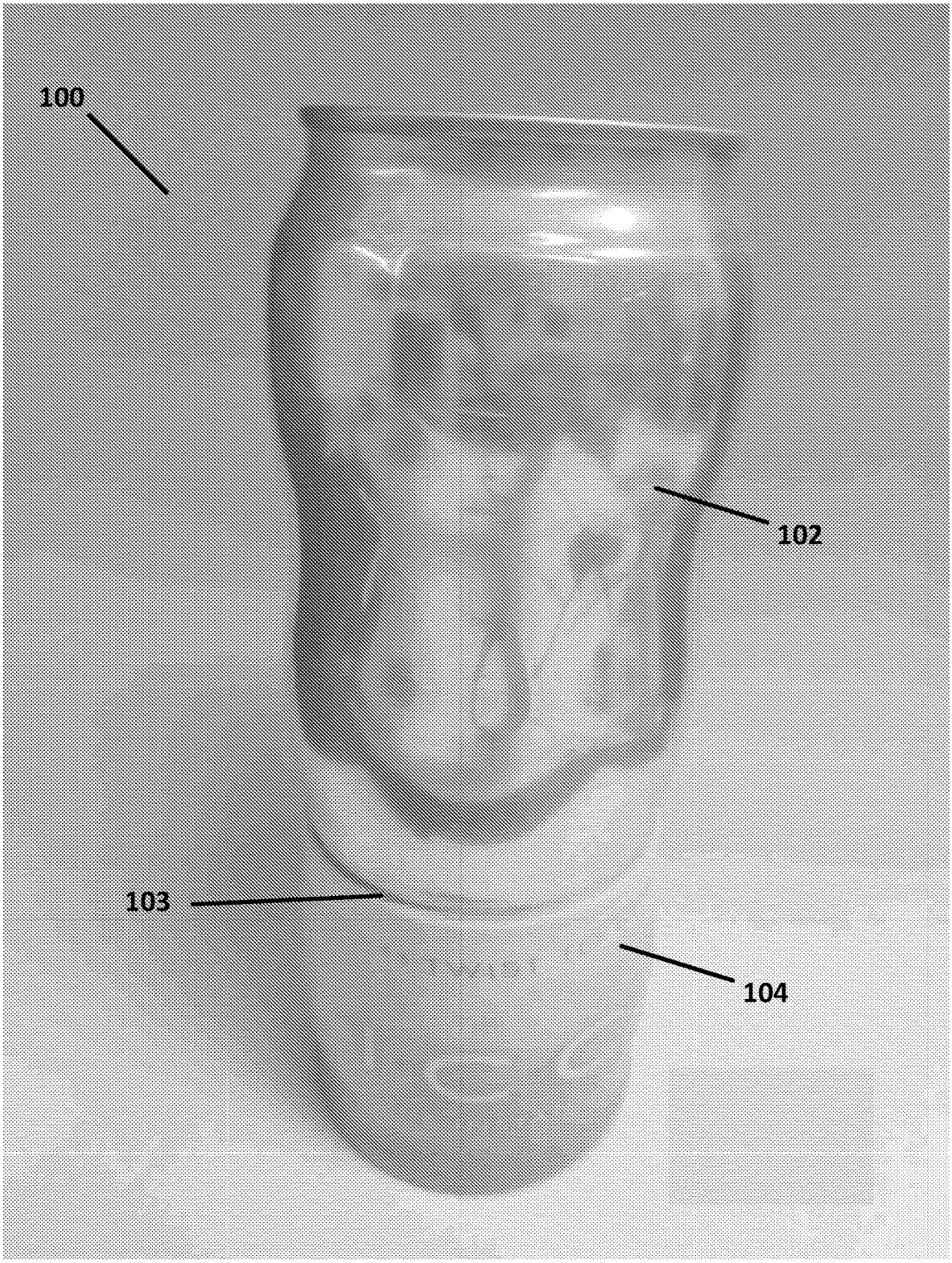
FIG. 9 is an external perspective view of an implementation of a self-cooling beverage can.

FIG. 9 is an external perspective view of an implementation of a self-cooling beverage can 100.

The illustrated self-cooling beverage can 100 has an upper portion 102 and a lower portion 104 demarcated from one another by a circumferential groove 103. The upper portion 102 has an internal beverage compartment with a beverage (e.g., beer, soda, etc.) and an internal evaporator unit with a refrigerant (e.g., water gel) that evaporates to cool the beverage when the beverage can's self-cooling functionality is activated. The lower portion 102 has an internal desiccant chamber to absorb moisture from the evaporated refrigerant and an internal heat sink to absorb heat from the desiccant. The self-cooling functionality of the beverage can 100 can be activated by a user twisting the upper portion 102 of the self-cooling beverage can 100 and the lower portion 104 of the self-cooling beverage can 100 in opposite directions (e.g., as reflected by the curved arrows in the figure).

When a user twists the upper portion 102 of the self-cooling beverage can 100 and the lower portion 104 of the self-cooling beverage can 100 in opposite directions, an activator assembly (not visible in FIG. 9, but see 106 in FIG. 1) disposed between the upper portion 102 and lower portion 104 of the self-cooling beverage can 100 responds to twisting and actuates the self-cooling functionality of the can 100.

Figure 1:
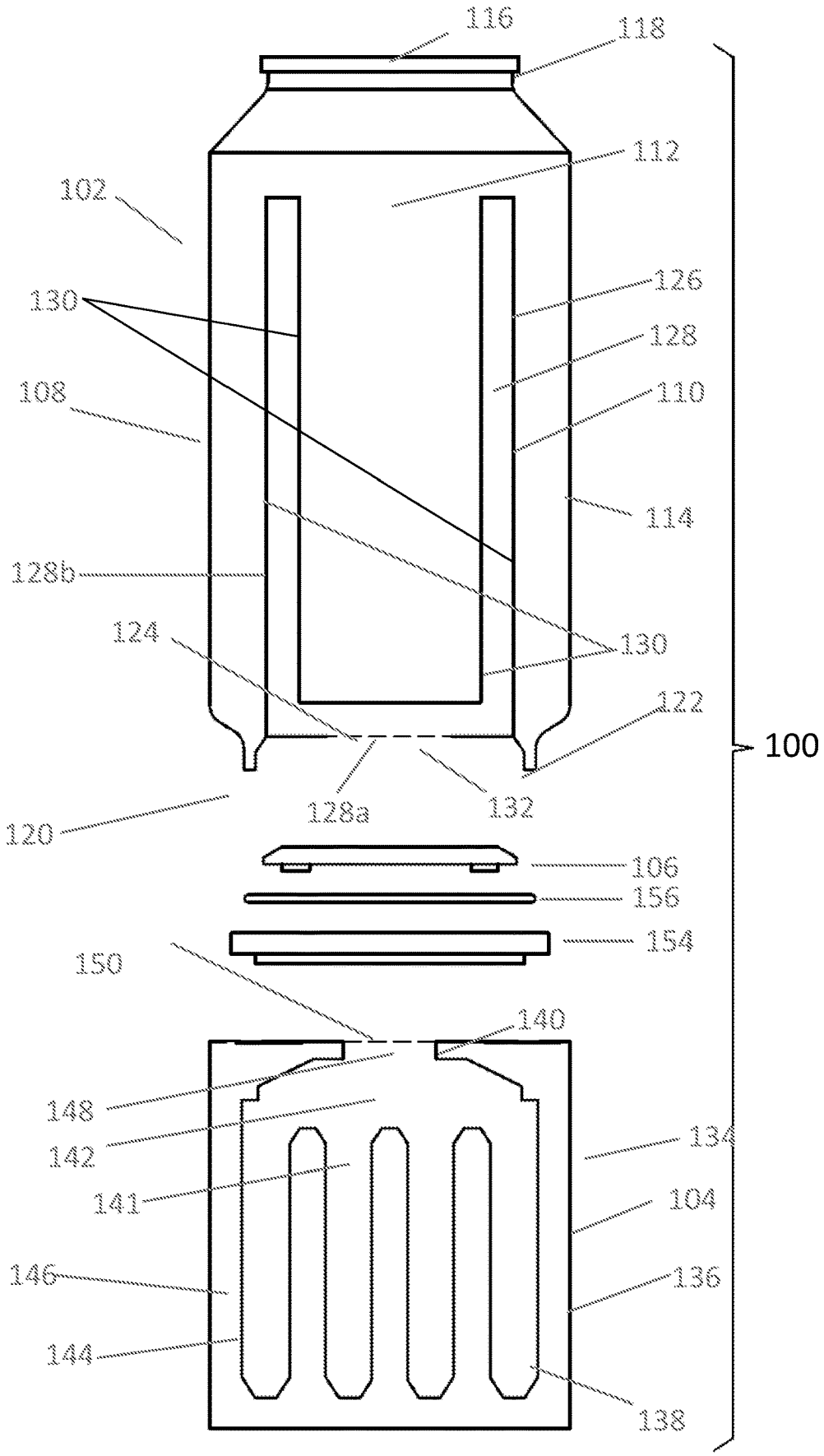
FIG. 1 is an exploded, side view of an implementation of a self-cooling beverage can with certain portions thereof shown in cross-section.

FIG. 1 is a schematic, exploded, side view of an implementation of the self-cooling beverage can 100 with certain portions thereof shown in cross-section.

The illustrated self-cooling beverage can 100 has an upper portion 102, a lower portion 104 and an actuator assembly 106. When assembled, the actuator assembly 106 sits between the upper portion 102 and the lower portion 106 of the self-cooling beverage can 100.

The upper portion 102 of the self-cooling beverage can 100 has an outer container 108 and an evaporator unit 110 with a beverage compartment 112 therebetween. A first frangible seal extends across an opening at the bottom of the upper portion 102 of the self-cooling beverage can 100 to seal off the evaporator unit 110.

The outer container 108 of the upper portion 102 of the self-cooling beverage can 100 has a can body 114 and a can lid 116. The can body 114 may be constructed from a single piece of aluminum or steel, for example, machined into the shape represented in the illustrated implementation, which includes a cylindrical side, a neck at the top of the cylindrical side and a base at the bottom of the cylindrical side. The can lid 116 may be manufactured from an aluminum alloy and attached to the can body 114 with a flange connection 118. The can lid 116 typically has an opening mechanism (e.g., a pop-tab, stay-on-tab, etc.) that permits a user to open the outer container 108 and gain access to the beverage inside the beverage compartment 112. The beverage inside the beverage compartment 112 can be virtually any kind of drinkable liquid including, for example, a carbonated soft drink, an alcoholic drink, a fruit juice, a tea, an energy drink, etc.

The evaporator unit 124 in the illustrated implementation includes an evaporator housing 126 that defines an evaporator compartment 128 with internal surfaces (e.g., 130). More specifically, the evaporator compartment 128 in the illustrated implementation has a bottom section **128*a* and an annular section 128*b*. The bottom section 128*a* of the evaporator compartment 128 forms a hollow, short, cylindrical chamber at the bottom of the beverage compartment 112. The annular section 128*b* of the evaporator compartment 128 forms a hollow, annular chamber that extends up from an outer edge of the cylindrical bottom section 128*a* of the evaporator compartment 128 around an entire periphery of the cylindrical bottom section 128*a*. The annular section 128*b* extends in the upward direction a substantial length (e.g., at least 60%, at least 70% or at least 80%) of the overall height of the inside of the outer container 108. As shown, the beverage in the beverage compartment 112 is in direct physical contact with (and, therefore, direct thermal contact with) external surfaces of the evaporator unit 110. Accordingly, when the cooling effect is initiated in the self-cooling beverage container 100, heat is drawn out of the beverage in the beverage compartment 112 and into refrigerant contained in the evaporator unit 110, thus cooling the beverage. As shown, the inside of the annular section 128*b* of the evaporator chamber 128 is open to (and, therefore, in free fluid communication with) the inside of the cylindrical bottom section 128*a* of the evaporator compartment 128**.

The evaporator compartment 128 contains refrigerant. The refrigerant may be in the form of a water gel, for example, and typically is applied to the inner surfaces 128 of the evaporator container 128. Water gel is a generally safe, non-toxic, gelatinous (or semi-solid) substance that has a large amount (e.g., more than 80%, 85%, 90%, or 95%) of water. The water gel may be in spherical form and may include a water-absorbing superabsorbent polymer (SAP, also known as slush powder in dry form, e g., a polyacrylamide). In a typical implementation, the inner surfaces 128 of the evaporator compartment 128 are coated with water gel throughout the evaporator housing 126. More specifically, in a typical implementation, prior to activation, the water gel is covering a large portion (e.g., more than 80%, 85%, 90%, or 95%) of the inner surfaces 130 of the evaporator compartment 128.

The base 120 of the outer container 108 is contoured to define an annular downward-facing projection 122 at or near a circumferential outer edge of the base 120. The base 120 also is contoured to define an opening 124 that extends through the base 120 and into the evaporator compartment 128. The opening 124 may be circular and typically is centrally disposed in the base 120 of the outer container 108. The size of the opening 124 can vary. However, in various implementations, the size of the opening may be anywhere from at least 30% (or at least 40%, or at least 50%, or at least 60%, or at least 70%, or at least 80%, or at least 90%) of the area defined by the circular bottom tips of the annular, downward-facing projection 122.

The opening 124 in the base 120 of the upper portion 102 in the illustrated implementation is covered by a first frangible seal 132 that extends across, covers, and thereby blocks fluid flow through, the opening 124. When intact, the first frangible seal 132 prevents fluid from flowing through the opening 124 either into or out of the evaporator compartment 128. In some implementations, the first frangible seal 132 is a foil (e.g., a thin piece of material, such as metal, etc.) and is attached to the inner or outer surface of the base 120 of the outer container 108. In various implementations, the foil may be attached to the surface of the base using an adhesive material or by any other type of attachment method. The foil is configured to break (e.g., tear, rip, become detached, etc.) in response to the application of a pressing force and/or tearing forces against or to the foil. Once the foil has been broken, fluid is free to flow through the opening 124 between the evaporator compartment 128 and spaces external to the evaporator compartment 128.

The bottom section 128*a* of the evaporator compartment 128 in the illustrated implementation extends all the way to the first frangible seal 132 so that, when intact, the first frangible seal 132 essentially closes off and seals shut the evaporator compartment 128, but, when compromised, fluid is free to flow into or out of the evaporator compartment 128 through the opening 124, as relative pressures dictate.

The lower portion 104 of the self-cooling beverage can 100 serves as a condenser unit 134 for the self-cooling beverage can 100. The illustrated condenser unit 134 has an outer housing 136 and an inner housing 138. The outer housing 136 has surfaces that define a cylindrical side, a contoured top, and a substantially flat bottom. The outer diameter of the cylindrical side of the outer housing 136 matches the outer diameter of the outer container 108 of the upper portion 102 of the self-cooling beverage can 100. The inner housing 138 (or "absorber") defines an internal desiccant chamber 141 that includes an upper chamber portion 142 and a plurality of finger chambers 144, each of which extends in a downward direction from the upper chamber 142. In a typical implementation, each finger chamber 144 has a length that is equal to a substantial portion (e.g., at least 60%, at least 70%, or at least 80%) of the overall height of the interior of the inner housing 138.

The internal desiccant chamber 141 contains a desiccant. In a typical implementation, a desiccant is a substance that is able to absorb water (e.g., evaporated water gel) from its environment. In some implementations, the desiccant is in a solid form. One example of a desiccant is silica gel, which is an otherwise inert, nontoxic, water-insoluble white solid substance.

The inner housing 138 is largely contained within the outer housing 136 with only a small tubular extension 140 portion of the inner housing 138 extending to an upper surface of the outer housing 136. The inner housing 138, together with the outer housing 136, collectively define a heat sink chamber 146 therebetween. The heat sink chamber 146 contains a heat sink material that may, in some instances, undergo a phase change (e.g., by melting) when it is exposed to a source of heat and draws heat away from that source of heat. For example, the heat sink material may melt when it is exposed to heat in the desiccant chamber and draws that heat away from the desiccant chamber. Acetate is one example of a heat sink material. As shown, the heat sink material is in direct physical contact with (and, therefore, direct thermal contact with) external surfaces of the desiccant chamber 141. Accordingly, when desiccant in the desiccant chamber 141 heats up, that heat can readily escape the desiccant through the wall of the heat sink chamber 146 and into the heat sink material contained therein.

There is an opening 148 at the top of the tubular extension 140 portion of the inner housing 138. The opening 148 may be circular is shape and is centered on the circular top of the tubular extension 140. The opening 148 in the illustrated implementation opens into the desiccant chamber 141. In a typical implementation, the opening 148 may be the same size or approximately the same size as the opening in the base 120 of the upper portion 102. Moreover, when assembled (e.g., when the lower portion 104 of the self-cooling beverage can 100 is coupled to the upper portion 102 of the self-cooling beverage can 100), the opening 148 at the top of the tubular extension 140 aligns with the opening 124 in the base 120 of the upper portion 102 of the self-cooling beverage can 100.

A second frangible seal 150 extends across the opening 148 at the top of the tubular extension 140 to seal off the desiccant chamber 141. Thus, when intact, the second frangible seal 150 prevents fluid from flowing through the opening 148 either into or out of the desiccant chamber 141. In a typical implementation, the second frangible seal 150 is structurally similar to the first frangible seal 150. For example, in some implementations, the second frangible seal is a foil (e.g., a thin piece of material, such as metal, etc.). Moreover, it typically is attached to the inner or outer surface of the top of the tubular extension 140. In various implementations, the foil may be attached to the surface of the tubular extension 140 using an adhesive material or by any other type of attachment method. The foil is configured to break (e.g., tear, rip, become detached, etc.) in response to the application of a pressing force and/or tearing forces against or to the foil. Once the foil has been broken, fluid is free to flow through the opening 148 between the desiccant chamber 141 and spaces external to the desiccant chamber 141.

The top of the upper chamber 142 of the condenser unit 134 in the illustrated implementation extends all the way to the second frangible seal 150 so that, when intact, the second frangible seal 150 essentially closes off and seals shut the desiccant chamber 141, but, when compromised, fluid is free to flow into or out of the desiccant chamber 141 through the opening 148, as relative pressures dictate.

The upper outer surface of the lower portion of the 104 of the self-cooling beverage can 100 is contoured to define an annular groove that can receive and mate with a corresponding annular extension formed in the piece that sits immediately above it.

The actuator assembly 106 sits between the upper portion 102 and the lower portion 104 of illustrated self-cooling can 100. The illustrated actuator assembly 106 includes a cutter assembly 152, a drive gear assembly 154 and an O-ring 156, all represented with side views (not cross-sectional views) in FIG. 1 and is operable to actuate the cooling functionality in the self-cooling beverage can 100.

Figure 2:
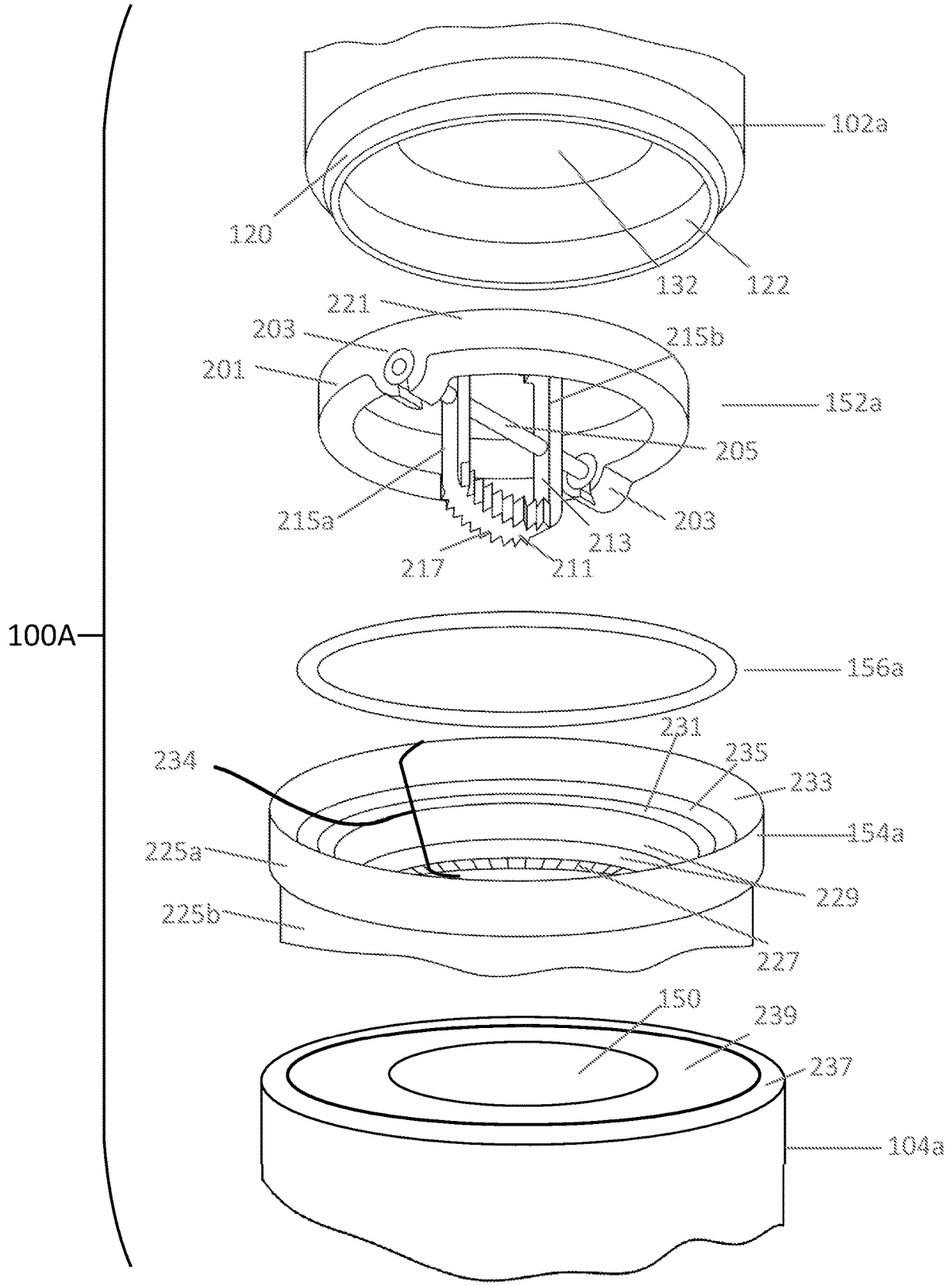
FIG. 2 is a partial, perspective, exploded, side view showing an implementation of an actuator assembly, positioned between an upper portion and a lower portion of a self-cooling beverage can.

FIG. 2 is a partial, perspective, exploded, side view showing an implementation of an actuator assembly 106*a*, positioned between an upper portion 102*a* and a lower portion 104*a* of a self-cooling beverage can 100*a*. As in FIG. 1, the illustrated actuator assembly 106*a* includes a cutter assembly 152*a*, a drive gear assembly 154*a*, and an O-ring 156*a* and is operable to actuate the cooling functionality in the self-cooling beverage can 100*a*.

The cutter assembly 152*a* has a cutter support (which, in the illustrated implementation, is a rigid annular body 201 with a pair of axle support surfaces 203 attached to or integral to the rigid annular body 201). The axle support surfaces 203, which may be axle sockets and/or bearings, are at diametrically opposite sides of the circular central opening defined by the rigid annular body 201. The axle 205, which is supported by the axle support surfaces 203, extends diametrically across the central opening of the rigid annular body 201 essentially bisecting the central opening. A pinion gear 109 is mounted onto the axle 205 and is configured to rotate with the axle 205 about a longitudinal axis of the axle 205. A cutter 211 also is mounted onto the axle 266 and also is configured to rotate with the axle 205 about the longitudinal axis of the axle 205.

The cutter 211 includes rigid body 213 mounted to (or integrally formed with) the axle 205. The rigid body 213 of the cutter 211 has two mirror image segments 215*a*, 215*b* that extend in from the axle 266 in opposite directions perpendicular to the longitudinal axis of the axle 266. Each segment 215*a*, 215*b* has a semicircular outer edge portion and a pair of straight portions that connect the ends of the semicircular outer edge portion to the axle 266. The space bounded by each respective segment 215*a* or 215*b* and the axle 266 is empty. The segments 215*a*, 215*b* are aligned with one another and extend along a common plane (i.e., they are coplanar). In the illustrated implementation, each segment 215*a*, 215*b* has a pair of serrated edges 217, each serrated edge 217 extending away from the common plane. Typically, for each segment, one of the serrated edges (e.g., 217, which is visible in FIG. 2) faces one direction and the other one of the serrated edges (not visible in FIG. 2 but see FIG. 7C) faces another direction (e.g., opposite the first). In various implementations, the serrated edges may extend around an entirety of each semicircular outer edge portion and pair of straight portions, or the serrated edges may extend around only part of each semicircular outer edge portion and pair of straight portions. For example, in some implementations, the serrated edges are only on the semicircular outer edge portions of the segments 215*a*, 215*b*.

In a typical implementation, the cutter assembly 152*a* fits and seals against the base 120 of the upper portion 102*a* of the self-cooling beverage can 100*a*. An adhesive material may be applied between portions of the cutter assembly 152*a* and the base 120 to attach the cutter assembly 152*a* to the base 120. In some implementations, portions of the rigid annular body 201 of the cutter assembly 152*a* may be contoured to follow corresponding contours on the base 120 of the upper portion 102*a* of the self-cooling beverage can 100*a*. More specifically, in certain implementations, the cutter assembly 152*a* is sized to fit up into the space surrounded by the annular downward facing projecting 122 on the base 120 of the upper portion 102*a* of the self-cooling beverage container 100*a*. Moreover, in some such implementations, an outer side surface 221 of the annular body 201 of the cutter assembly 152*a* follows the same contours as a facing surface of the annular downward facing projection 122 on the base 120 of the upper portion 102*a* of the self-cooling beverage container 100*a*. This sort of arrangement helps ensure a lot of surface area contact between the annular body 201 of the cutter assembly 152*a* and the annular downward facing projection 122 of the base 120. Adhesive applied at the contact areas (and/or a friction fit and/or an external force pressing the two components together) aids in holding the two components (cutter assembly 152*a* and upper portion 102*a*) together.

The cutter 211 is centered in the circular space defined and surrounded by the annual body 201 of the cutter assembly 152*a*. The sealed opening 124 in the base 120 of the upper portion 102 of the self-cooling beverage can 100*a*, which is sealed by the first frangible seal 132, is centered within a circle defined by the annular downward-facing projection 122. Thus, when the cutter assembly 152*a* is attached to the base 120, the cutter 211 in the illustrated implementation automatically aligns with the opening 124 in the base 120 and with the first frangible seal 132 that covers the opening 124. Thus, when the cutter assembly 152*a* is attached to the base 120 of the upper portion 102 of the self-cooling beverage can 100*a*, and the axle 205 is rotated about its longitudinal axis, the cutter 211 and one of its serrated edges moves into and tears or otherwise compromises the first frangible seal 132, essentially unsealing the evaporator chamber 128. Depending on the direction that the axle 205 is rotated, the serrated edge on segment 215*a* or segment 215*b* that is facing the first frangible seal 132 will move into and compromise the first frangible seal 132.

A pinion gear (not visible in FIG. 2 but see 209 in other drawings) would be on the axle 205 between the cutting element 211 and one of the axle support surfaces 203 (i.e., the one with the V-groove in FIG. 2). In a typical implementation, the pinion gear 209 is closer to that axle support surface 203 than it is to the cutting element 211. This places the pinion gear 209 near (e.g., within about 1 or 2 centimeters of) an inner edge of the closest support surface 203. The pinion gear 209 may be a circular gear with gear teeth on its outer, circumferential surface.

The drive gear assembly 154*a* in the illustrated implementation has a rigid annular body 223. The rigid annular body 223 in the illustrated implementation has outer surfaces 231, an inner surface 233, upper surfaces 234, and a lower surface 235.

The outer surfaces 231 of the drive gear assembly 154*a* define a first cylindrical section 225*a* and a second cylindrical section 225*b* that is below the first cylindrical section 225*a*. In a typical implementation, the first cylindrical section 225*a* has a diameter that is the same as the diameter of the cylindrical body portion of outer container 108, and the same as the diameter of the cylindrical outer housing 136. The diameter of the second cylindrical section 225*b* is slightly smaller (e.g., less the 1% or 2%) than the diameter of the first cylindrical section 225*a*. In an exemplary implementation, the smaller diameter of the second cylindrical section 225*b*, relative to the first cylindrical section 225*a*, provides clearance for a rolled bead on the self-cooling beverage can 100*a*.

The inner surface 233 of the drive gear assembly 154*a* in the illustrated implementation is cylindrical and opposite and coaxial with the outer surfaces 231 of the drive gear assembly 154*a*. The inner surface 233 has a shorter height than the collective height of the outer surfaces 231, which include the first cylindrical section 225*a* and the second cylindrical section 225*b*.

The lower surface 235 of the drive gear assembly 154*a* extends between a lower edge of the inner surface 233 and a lower edge of the outer surfaces 231. The lower surfaces 235 in the illustrated implementation is flat, annular, and lies in a plane that is perpendicular to axes of the cylindrical outer surfaces 231 and/or the cylindrical inner surface 233.

The upper surfaces 234 of the drive gear assembly 154*a* extend between an upper edge of the inner surface 233 and an upper edge of the outer surfaces 231. Since the lower surface 235 of the drive gear assembly 154*a* is flat and lies in a horizontal plane when the self-cooling beverage can 100*a* is assembled and since the inner surface 233 of the drive gear assembly 154*a* is shorter than the outer surfaces 231 of the drive gear assembly 154*a*, the inner edge of the upper surfaces 234 is lower than the outer edge of the upper surfaces 234.

The upper surfaces 234 collectively define (from the inner edge, moving outward) an annular drive gear 227, a flat annular surface 229, a cylindrical surface 231, an annular cradle 233 for cradling an outer circumferential portion of base 120, and an annular O-ring groove 235 formed in the annular cradle 233.

The annular drive gear 227 forms a continuous ring of gear teeth that face upward and are positioned and configured to engage and mesh with corresponding gear teeth on the pinion gear 209 of the cutter assembly 152*a*. The flat annular surface 229 is immediately outside, surrounds, and is coaxially disposed relative to the annular drive gear 227. The cylindrical surface 231 extends in an upward direction from an outer edge of the flat annular surface 229 perpendicular to the flat annular surface 229. The cylindrical surface 231 also is coaxially disposed relative to the annular drive gear 227. The annular cradle 232 extends from an upper edge of the cylindrical surface 231 to the upper edge of the outer surfaces 231 of the drive gear assembly 154*a*. The annular cradle 233 has an inner section and an outer section. The outer section of the annular cradle 233 surrounds the inner section of the annular cradle 233. The inner section of the annular cradle 233 follows the contours of an outer edge of the annular downward-facing projection 122 of the base 120 of the upper portion 102*a* of the self-cooling beverage can 100*a*. The outer section of the annular cradle 233 follows the contours of a portion of the base 120 of the upper portion 102*a* of the self-cooling beverage can 100*a* that falls radially outside of the annular downward-facing projection 122. The annular O-ring groove 235 is formed in the outer portion of the annular cradle 233 about midway between the inner edge of the outer portion of the annular cradle 233 and the outer edge of the outer portion of the annular cradle 233.

The O-ring 156*a* is sized and configured to fit within the annular O-ring groove 235 in such a manner that a portion of the O-ring 156*a* extends up and out of the annular O-ring groove 235 to contact and seal against a mating surface on the base 120 of the upper portion 102*a* of the self-cooling beverage can 100*a*. The O-ring, in a typical implementation, is a mechanical gasket in the shape of a torus (e.g., a loop of elastomer with a round cross-section, designed to be seated in a groove (e.g., annular O-ring groove) and compressed during assembly between two parts (e.g., drive gear assembly 154*a* and base 120) forming a seal at the interface.

The flat, annular lower surface 235 of the drive gear assembly 154*a* gets adhered to (with an adhesive) an upper annular surface 239 on the top of the lower portion 104*a* of the self-cooling beverage can 100*a*. The upper annular surface 239 on the top of the lower portion 104*a* of the self-cooling beverage can 100*a* is surrounded, at its periphery, by a raised lip 237. When the flat, annular lower surface 235 of the drive gear assembly 154*a* gets adhered to the upper annular surface 239 on the top of the lower portion 104*a* of the self-cooling beverage can 100*a*, the raised lip 237 extends up and around the second cylindrical section 225*b* of the drive gear assembly 154*a*.

Figure 3:
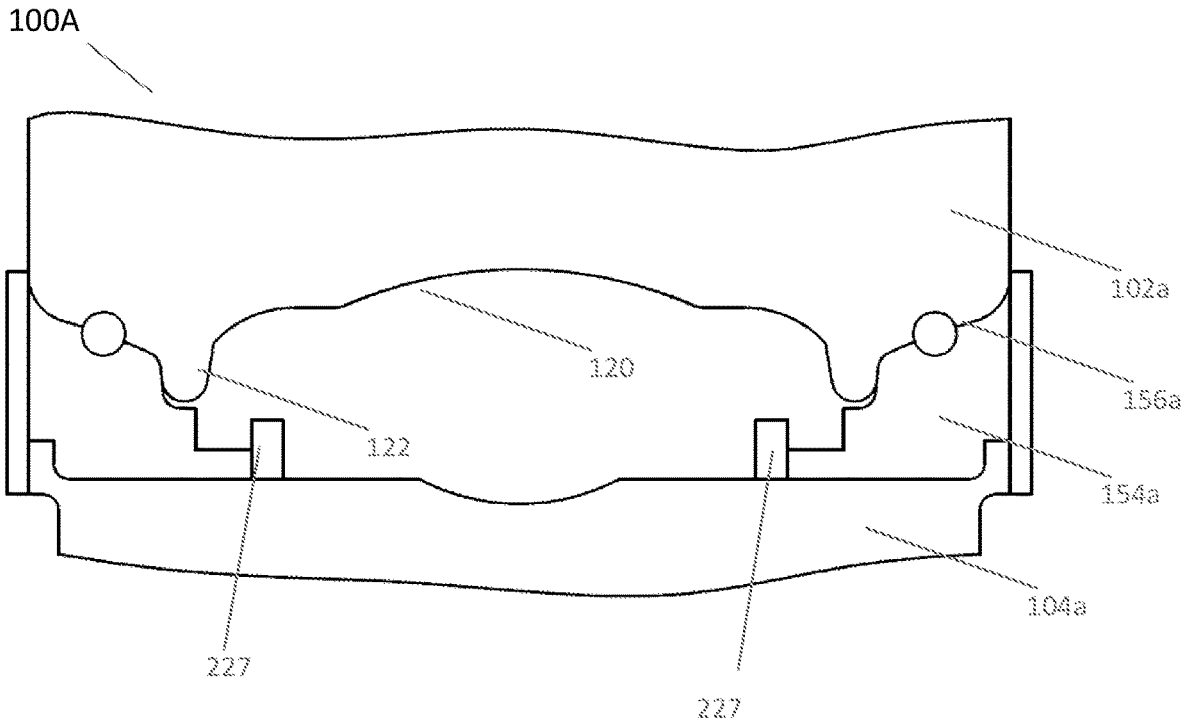
FIG. 3 is a partial, cross-sectional, side view of an implementation of the self-cooling beverage can of FIG. 2, assembled.

FIG. 3 is a partial, cross-sectional, side view of an implementation of the self-cooling beverage can 100*a*, assembled.

The components of the self-cooling beverage can 100*a* represented in the illustrated partial cross-sectional view include the upper portion 102*a*, the lower portion 104*a*, the drive gear assembly 154*a*, and the O-ring 154*a*. The self-cooling functionality of the self-cooling beverage can 100*a* has not been initiated in the illustrated configuration. Therefore, the first and second frangible seals 132, 150 are shown in an intact state (i.e., not ruptured or otherwise compromised) on the upper and lower portions 102*a*, 104*a*, respectively. In a typical implementation, one or more of the frangible seals may be bowed or curved based on a pressure differential across the frangible seal. The cutter assembly (e.g., 152*a* in FIG. 2) is not shown in the illustrated figure. However, in a fully assembled self-cooling beverage can, the cutter assembly 152*a* would be positioned in the empty space between the upper portion 102*a*, the lower portion 104*a*, and drive gear assembly 154*a*. (See, e.g., the partial, side, cross-sectional view in FIG. 4 and FIG. 7).

If the cutter assembly (e.g., 152*a* in FIG. 2) were positioned in the empty space between the upper portion 102*a*, the lower portion 104*a*, and the drive gear assembly 154*a*, the cutter 211 of the cutter assembly 152*a* would be located (approximately centered) in that empty space as well with its axle 205 spanning across the empty space and the cutter 211 disposed approximately midway along the length of the axle 205. The axle 205 also would be located approximately midway between the two frangible seals, with the two segments of the cutter 211 being approximately mirror images of one another and large enough to reach the frangible seals when the axle 205 is rotated. Moreover, if the cutter assembly 152*a* were so positioned, the pinion gear 209 on the cutter assembly axle 205 would be mated to the ring gear 227 on the drive gear assembly 154*a*. Thus, the annular drive gear 227 is located on the drive gear assembly 154*a* such that, when the self-cooling beverage container 100 is in an assembled state (such as in FIG. 7, for example), the gear teeth on the annular drive gear 227 engage the gear teeth on the pinion gear 209 on the cutter assembly 152*a*. Moreover, of course, the gear teeth on the two gears—the annular drive gear 227 and the pinion gear 209—are sized and shaped to mate/mesh with one another in a driving-driven relationship.

In a typical implementation, as mentioned herein, the cutter assembly 152*a* typically is attached to the base 120 of the upper portion 102*a* of the self-cooling beverage can 100 with an adhesive. In such implementations, the cutter assembly 152*a* is configured to move with, and in the same manner as, the upper portion 102*a* of the self-cooling beverage can 100. For example, if the upper portion 102*a* of the self-cooling beverage can 100 were to be rotated about an axis of the self-cooling beverage can 100, then the cutter assembly 152*a* also would rotate about the axis of the self-cooling beverage can 100 with the upper portion 102*a*.

Additionally, the drive gear assembly 154*a* in the illustrated implementation is adhered to an upwardly facing surface of lower portion 104*a* of the self-cooling beverage can 100 with an adhesive. In such implementations, the drive gear assembly 154*a* is configured to move with, and in the same manner as, the lower portion 104*a* of the self-cooling beverage can 100. For example, if the lower portion of the self-cooling beverage can 100 were to be rotated about the axis of the self-cooling beverage can 100, then the drive gear assembly 154*a* also rotates about the axis of the self-cooling beverage can 100 with the lower portion 104*a*.

Since, in a typical implementation, the cutter assembly 152*a* moves with, and in the same manner as, the upper portion 102*a* of the self-cooling beverage can 100 and the drive gear assembly 154*a* moves with, and in the same manner as, the lower portion 104*a* of the self-cooling beverage can 100, when the upper portion 102*a* of the self-cooling beverage can 100 and the lower portion 104*a* of the self-cooling beverage can 100 are rotated in opposite directions relative to one another about the axis of the self-cooling beverage container 100, the cutter assembly 152*a* and the drive gear assembly 154*a* also rotate in opposite directions relative to one another about the axis of the self-cooling beverage container 100.

Since the pinion gear 209 on the cutter assembly 152*a* is mated to the ring gear 227 on the drive gear assembly 154*a*, the ring gear 227 causes the pinion gear 209 and its axle 207 to turn when the cutter assembly 152*a* and the drive gear assembly 154*a* are rotated relative to one another. The axle 207 rotating causes the cutter 211 to rotate. In a typical implementation, the cutter assembly 152*a* is positioned and configured such that the axle 207 is approximately midway between the first frangible seal 132 and the second frangible seal 150 and the since two segments 215*a*, 215*b* of the cutter 211 are approximate mirror images of each other and symmetrical about the axle 207 (which is the case in a typical implementation), when the cutter 211 rotates (e.g., away from a substantially horizontal configuration), it eventually contacts and tears into (or otherwise compromises) the first frangible seal 132 and the second frangible seal 150 thereby opening/establishing a fluid flow path between the evaporator compartment 128 and the desiccant chamber 141.

Establishing a fluid flow path between the evaporator compartment 128 and the desiccant chamber 141 exposes the evaporator compartment 128 to the significantly lower pressure in the desiccant chamber 141, which causes the refrigerant (e.g., water gel) in the evaporator compartment 128 to evaporate thereby absorbing heat from the beverage surrounding the evaporator compartment 128 in the beverage compartment 112. This cools the beverage quickly and significantly.

Figure 4:
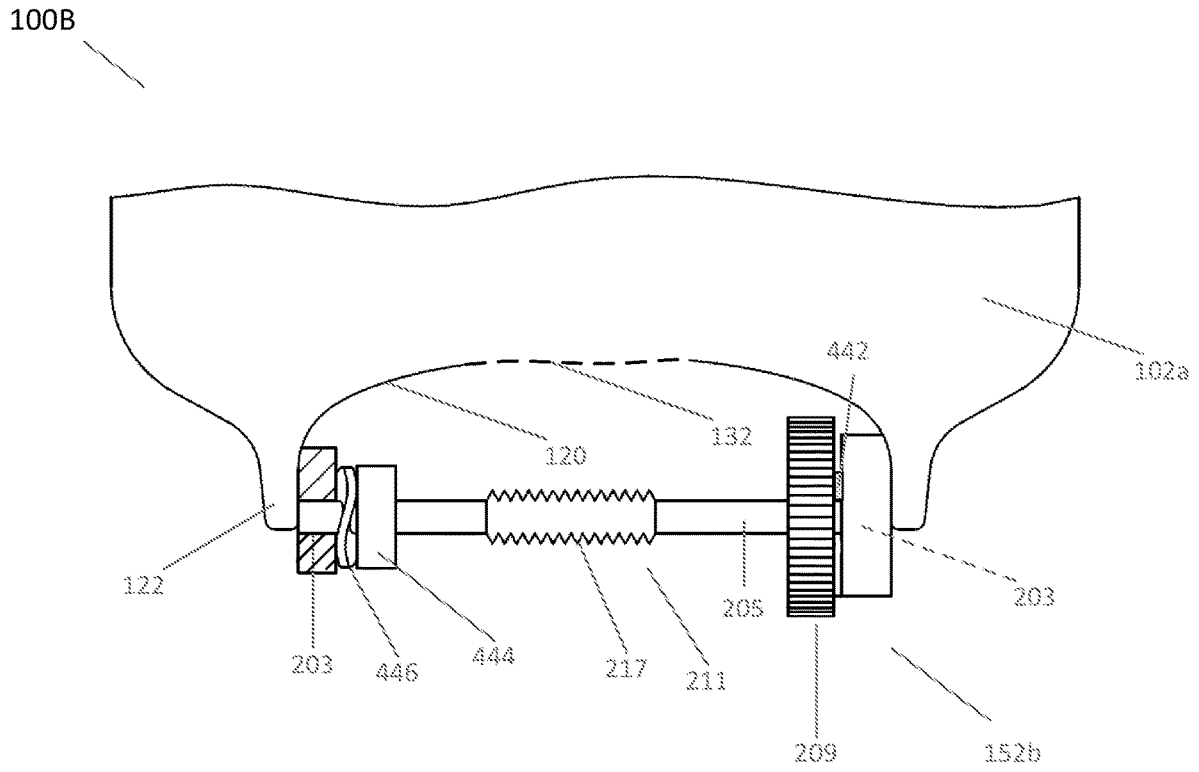
FIG. 4 is another partial, cross-sectional, side view of self-cooling beverage container of FIG. 2.

FIG. 4 is another partial, cross-sectional, side view of self-cooling beverage container 100*b*. The illustrated figure includes an inverted partial view of an upper portion 102*a* of a self-cooling beverage can 100*a* and an alternative implementation of a cutter assembly 152*b* mounted to the base 120 of the upper portion 102*a*.

The upper portion 102*a* of the self-cooling beverage container 100*b* has a frangible seal 132 that covers an opening in a base 120 of the upper portion 102*a*. Until ruptured, the frangible seal 132 prevents fluid flow out of (or into) an evaporator compartment (e.g., 128) in the upper portion 102*a*. The cutter assembly 152*b* has a cutter 211 that is mounted or integrated into a rotatable axle 205 and configured to cut through the frangible seal 132 thereby establishing a fluid flow path into the evaporator compartment (e.g., 128) when the rotatable axle is rotated.

The cutter 211 is shown in the illustrated figure lying in a plane that is perpendicular to the axis ("A") of the self-cooling beverage can 100. Therefore, some of its features are difficult to see. The cutter 211 can have any one of a variety of different physical configurations. In some implementations, the cutter 211 may be configured as shown in any one of the figures contained herein that shows a cutter. The cutter 211 is coupled to (e.g., mounted onto or integrally formed with) the rotatable axle 205 and configured to rotate about an axis of the rotatable axle 205 with and in the same manner as the rotatable axle 205. The pinion gear 209 is coupled to the rotatable shaft, too, and also is configured to rotate about an axis of the rotatable axle 205 with and in the same manner as the rotatable axle 205. The rotatable axle 205 is supported at opposite ends thereof by axle support surfaces 203 that may be (or be part of) bearings that support the axle 205, while allowing the axle 205 to rotate about its axis. Each of the axle support surfaces 203 is part of or supported with the rigid annular body 201 of the cutter assembly 152*b*. Moreover, in a typical implementation, the rigid annular body 201 is adhered (e.g., with an adhesive material in the joint therebetween) to the base 120 of the upper portion 102*a* between the annular downward-facing projection 122.

The configuration of the cutter 211 within the self-cooling beverage can 100*b* shown in the illustrated figure (i.e., lying in the plane that is perpendicular to the axis ("A") of the self-cooling beverage can 100*b*) is a preferred configuration until and unless a user has taken deliberate action to initiate the can's self-cooling functionality (e.g., by twisting the upper portion 102*a* of the can relative to the lower portion 104*a* of the can). This is true even when the self-cooling beverage can 100*b* is being assembled. That is because the cutter 211, as shown, is configured so that it is far away from the frangible seal 132 in the upper portion 102*a* and (although not shown in FIG. 4) far away from the frangible seal 150 in the lower portion 104*a*. This minimizes the risk of accidentally setting off the cooling functionality when doing so is not intended.

The implementation shown in the illustrated figure has provisions tending to keep the cutter 211 in the illustrated position/configuration. In a typical implementation, these provisions keep the cutter 211 in a desired position/configuration (e.g., as shown in FIG. 4) unless and until a user deliberately applies an external force to urge the cutter 211 out of the indicated position/configuration and, for example, toward the frangible seals. These provisions include a notch 440 formed in a surface of the rigid annular body 201 (facing the pinion gear 209), a projection 442 that extends out from a side surface of the pinion gear 209, a boss 444 near an opposite end of the axle 205 from the pinion gear 209 and an axial spring 446 (e.g., wave or spring washer) between the boss 444 and an inner surface of the annular rigid body 201. In operation, the projection 422 fits into the notch 440 and the axial spring 446 pushes against the boss 444 and the inner surface of the annular rigid body 201 to urge (and help keep) the projection 442 engaged with and inside the notch 440. The engagement between the projection 442 and the notch 440 creates a resistance to the axle being able to turn. This resistance, in a typical implementation, can be overcome with relative ease by a user deliberately applying a twisting force to the upper portion 102*a* of the can 100*b* relative to the lower portion 104*a* of the can 100*b*. In a typical implementations, when the upper portion and lower portion are rotated with respect to each other the projection pops out of the V-shaped groove, allowing the upper portion and lower portion to rotate relative to one another. The cutter assembly 152*b* is configured such that the cutter 211 is disposed as shown when the projection 442 is in the notch 440.

The specific configuration of these provisions (that help keep the cutter 211 in the position/orientation shown in FIG. 4) can vary. In a typical implementation, the notch 440 is V-shaped with the low point of the "V" extending in a vertical up and down direction. The top of the notch 440 may be close to (or at) the support surface hole 203 for the axle 205 and the notch 440, in some implementations, may extend down to the bottom of the annular rigid body 201. The projection 442 also may be V-shaped. The projection 442 may be disposed along a radial line on the outer circular side of the pinion gear 209. The radial line may be perpendicular to the plane in which the cutter 211 lies when the projection 442 is in the notch 440. The boss 444 may be a solid cylindrical body that is coupled to (e.g., mounted to or integrally formed with) the axle 205. The solid cylindrical body has a diameter that is larger than a diameter of the axle 205 and has a circular side surface that contacts the axial spring. The axial spring 446 may be a wave washer that fits over the axle 205 and has a "wave" in the axial direction that provides a spring pressure (e.g., against the boss 444 and the inner surface of the rigid annular body 201 when compressed. Typically, the inner circular aperture of the wave washer would be slightly larger than the axle 205.

Figure 5:
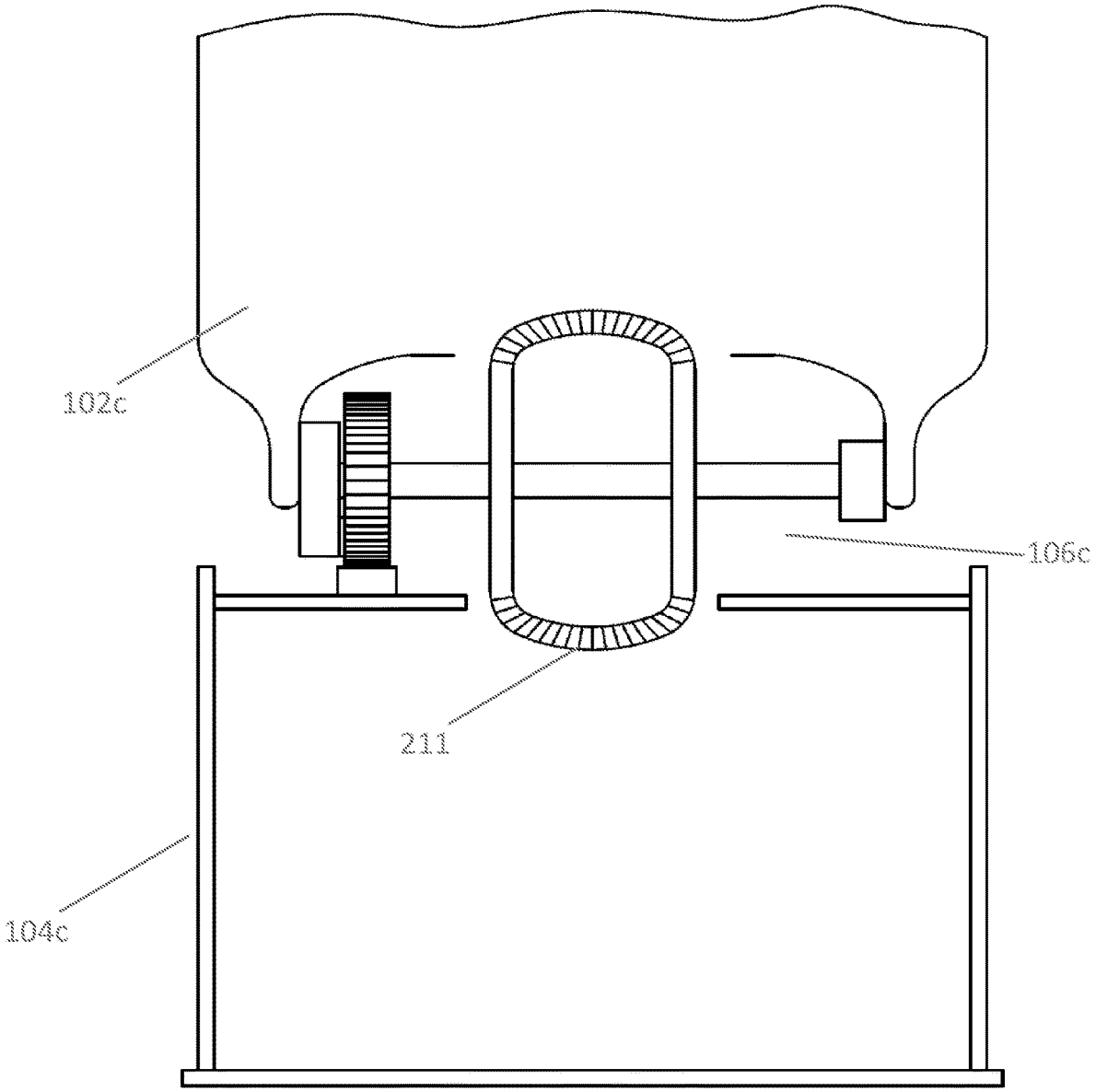
FIG. 5 is a partial, schematic, side, cross-sectional view of an exemplary self-cooling beverage can.

FIG. 5 is a partial, schematic, side, cross-sectional view of an exemplary self-cooling beverage can 100*c*. The illustrated self-cooling beverage can 100*c* has an upper portion 102*c* and a lower portion 104*c* coupled to one another. The upper portion 102 has an internal beverage compartment with a beverage (e.g., beer, soda, etc.) and an internal evaporator unit with a refrigerant (e.g., water gel) that evaporates to cool the beverage when the beverage can's self-cooling functionality is activated. The lower portion 102 has an internal desiccant chamber to absorb moisture from the evaporated refrigerant and an internal heat sink to absorb heat from the desiccant. The self-cooling functionality of the beverage can 100*c* can be activated by a user twisting the upper portion 102 of the self-cooling beverage can 100*c* and the lower portion 104 of the self-cooling beverage can 100*c* in opposite directions.

When a user twists the upper portion 102 and the lower portion 104 in opposite directions, the activator assembly 106*c* (partially shown in FIG. 5), which is disposed between the upper portion 102 and lower portion 104, responds to twisting action by actuating the self-cooling functionality of the can 100*c*. In this regard, the twisting motion causes the cutter 211 to change its orientation from a first orientation where it is lying substantially in a plane that is perpendicular to the axis of the beverage can 100 (e.g., like in FIG. 4) to a second orientation where at least the outer edges of the cutter 211 have broken through the frangible seals (e.g., as shown in FIG. 5). The cutter 211 in the illustrated implementation is approximately halfway through a full swing (e.g., a full sweeping away of the frangible (e.g., foil) seals.

Figure 6:
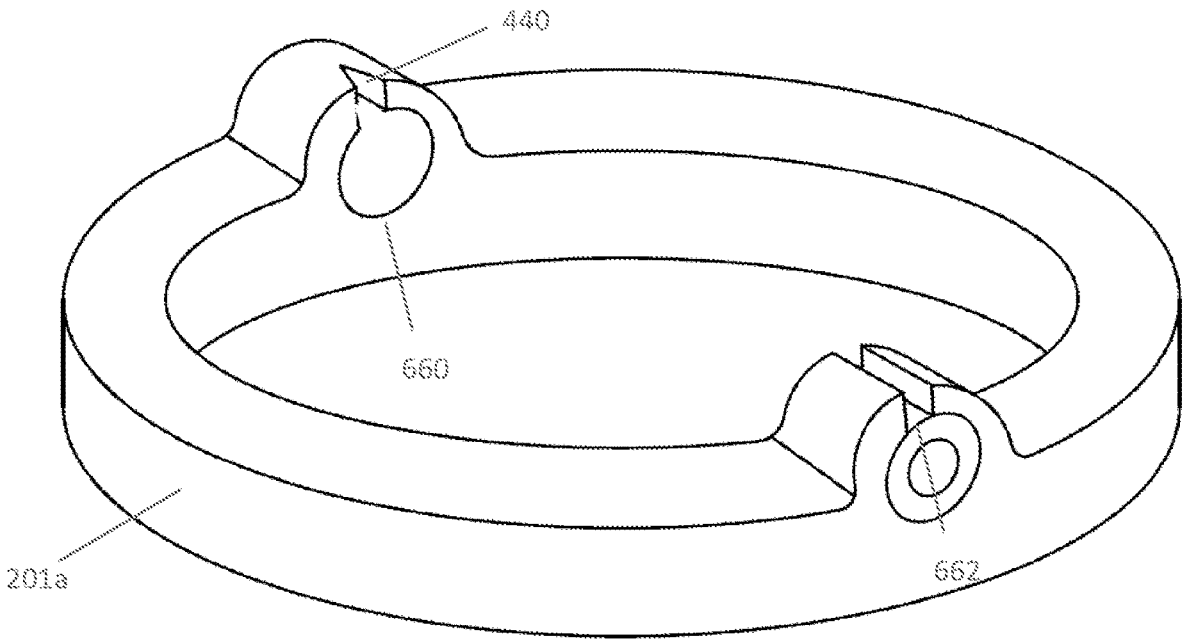
FIG. 6 is a perspective view of an implementation of a rigid annular body for a cutter assembly.

FIG. 6 is a perspective view of an implementation of a rigid annular body 201*a* for a cutter assembly (e.g., 152*a*).

Much of the illustrated rigid annular body 201*a* has a flat annular surface (at the bottom in the illustrated figure), an annular outer surface, an annular inner surface, and a surface (at the top of the illustrated figure) that has bump ups at diametrically opposite sides of the body 201*a*. The bump ups correspond to and accommodates support surfaces for the axle (e.g., 205). In the illustrated example, the axle support surfaces are provided by a socket 660 at one side of the rigid annular body 201 and a snap-in bearing 662 at an opposite side of the rigid annular body 201. The socket 660 in the illustrated implementation is simply an opening or hollow in the rigid annular body 201 that forms a holder for the axle 215. The snap-in bearing 662 is a bearing with a split housing that allows the axle 205, during assembly, to be pushed down against the split and snapped in through the split into engagement with the bearing 662.

The flat annular bottom surface in the illustrated implementation are shown as separate surfaces separated from each other by an angled (e.g., 90 degrees) corner. In some implementations, however, these surfaces may be combined into one contoured surface (e.g., as shown in FIG. 4) that matches a corresponding surface on the base 120 of an upper portion 102*a* of a can. The rigid annular body 201 may be bonded/adhered to the base 120 of the can.

A notch 440 is formed in the inner surface of the rigid annular body 201 above the socket 660. The illustrated notch 440 is V-shaped, with a center of the V-shape (i.e., the deepest part of the notch) extending in a vertical direction from the top of the socket 660 upward. The V-shaped notch 440 in the illustrated example extends all the way to the top surface of the corresponding bump up on the rigid annular body 201. As discussed elsewhere herein, the V-shaped notch 440 is configured to engage a corresponding V-shaped projection on a side surface of a pinion gear (e.g., 209). This helps prevent undesirable motion (e.g., turning) of the axle 205 and the cutter 211 during assembly, shipping, and storage (before use).

Figure 7A:
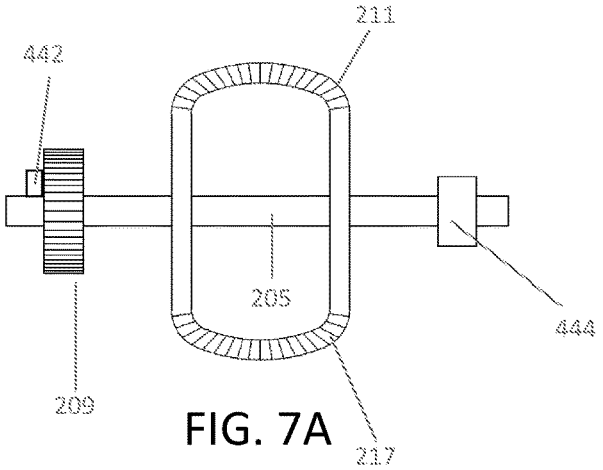
FIGS. 7A-7C are views of an implementation of a rotatable portion of a cutter assembly.
Figure 7B:
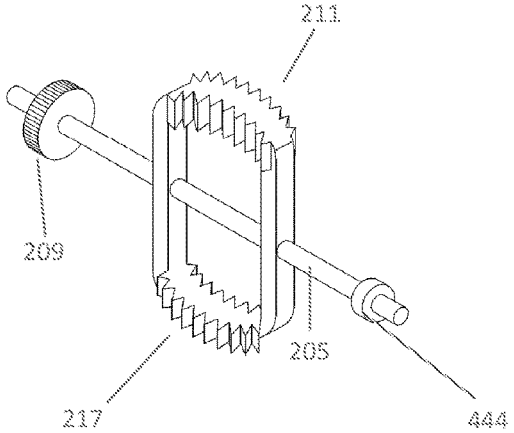
Figure 7C:
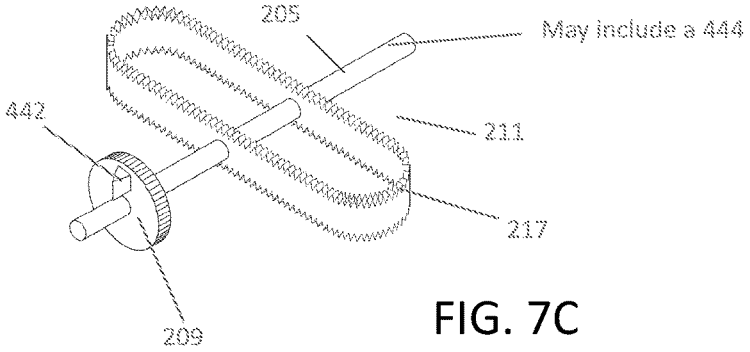

FIGS. 7A and 7B are views of an implementation of a rotatable portion of a cutter assembly (e.g., 152*a*). FIG. 7C is an alternative implementation of a rotatable portion.

Each of the illustrated rotatable portions includes an axle 205. A pinion gear 109 is mounted onto the axle 205 and is configured to rotate with the axle 205 about a longitudinal axis of the axle 205. A cutter 211 also is mounted onto the axle 266 and also is configured to rotate with the axle 205 about the longitudinal axis of the axle 205.

The cutter 211 includes rigid body 213 mounted to (or integrally formed with) the axle 205. The rigid body 213 of the cutter 211 has two mirror image segments 215*a*, 215*b* that extend in from the axle 266 in opposite directions perpendicular to the longitudinal axis of the axle 266. Each segment 215*a*, 215*b* has a semicircular outer edge portion and a pair of straight portions that connect the ends of the semicircular outer edge portion to the axle 266. The space bounded by each respective segment 215*a* or 215*b* and the axle 266 is empty. The segments 215*a*, 215*b* are aligned with one another and extend along a common plane (i.e., they are coplanar). In the illustrated implementation, each segment 215*a*, 215*b* has a pair of serrated edges 217, each serrated edge 217 extending away from the common plane. Typically, for each segment, one of the serrated edges faces one direction and the other one of the serrated edges faces another direction (e.g., opposite the first). In various implementations, the serrated edges may extend around an entirety of each semicircular outer edge portion and pair of straight portions, or the serrated edges may extend around only part of each semicircular outer edge portion and pair of straight portions. For example, in some implementations, the serrated edges are only on the semicircular outer edge portions of the segments 215*a*, 215*b*.

Figure 8:
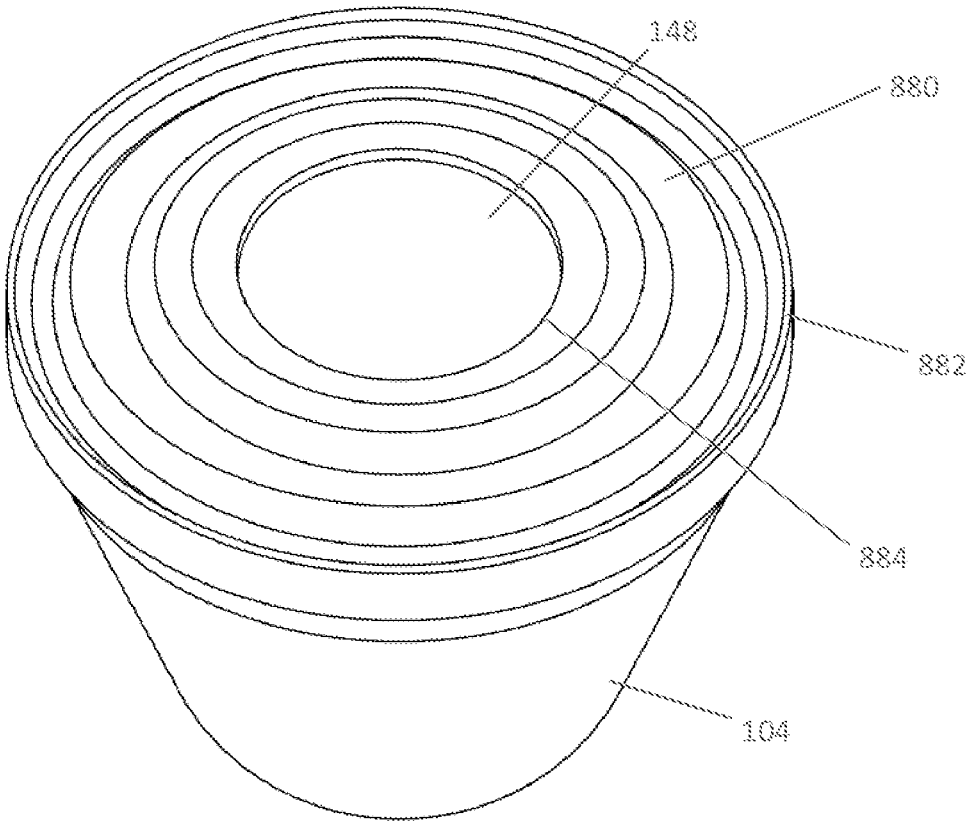
FIG. 8 is a top perspective view of an implementation of the lower portion 104 of the self-cooling can.

FIG. 8 is a top perspective view of an implementation of the lower portion 104 of the self-cooling can (e.g., 100). The top surface 880 of the lower portion 104 is fairly simple in construction, with some minor annular waves. In some implementations, the top surface 880 in its entirety (e.g., from the edge seam 882 to the circular edge of the opening 148) is flat. In some implementations, much of the top surface 880 may be flat. Notably, a portion of the upper surface 880 that immediately surrounds (and forms) the circular edge of the opening 148 is flat. This flat portion around the opening 148 in the upper surface 880 can vary in size. At its smallest, it should be large enough to allow sealing (with adhesive) of the frangible seal over the opening 148. At its largest, it covers the entirety of the upper surface (e.g., from the edge seam 882 to the circular edge of the opening 148). In an exemplary implementation, that flat portion spans a radial distance that is between 5% and 40% (e.g., 10% and 30%, or 15% and 25%) the distance along a straight radial line from the edge of the 884 of the opening 148 to an inner edge of the seam 882.

In view of the foregoing, it can be seen that, in an exemplary implementation, a disposable (e.g., single-use) self-cooling beverage can consists of two principal components, which in the assembled configuration are coupled together with an actuating mechanism therebetween. The two principal components are an evaporator, which is permanently installed in a standard beverage-style can, and an absorber unit, which contains both a vapor absorber (e.g., a desiccant) and a heat sink (or heat absorber) in a standard food-style can. Each of these units is evacuated and sealed with a centrally located tear-able or frangible foil. The foils are arranged so that they face each other across a gap (e.g., between the two principal components) when the final assembly is completed.

In the final assembly the actuating mechanism is installed in such a way that when the top and bottom of the can are rotated in opposite directions, the two foils are torn away, allowing the water vapor in the evaporator to flow into the absorber, where it is condensed. Because the absorber condenses the water vapor at lower pressure than that existing in the evaporator, the flow continues until all of the water is used up or the absorbent abilities of the desiccant are expended. In an optimum design, both events occur at the same time. No compressor is required in this refrigerator.

In a test market device, an evaporator was installed in a beverage can, evacuated and sealed, and then the assembly went to a beverage canner, where it was filled, lidded, and autoclaved to render the beverage shelf stable. The filled can was then moved to the final assembly where it was mated to an absorber. An image of the completed assembly is shown in FIG. 9. In this case, specially shaped cans were used in an effort to make the refrigerated cans stand out, visibly, on a grocery store shelf. The foil cutting assembly is in part of the flow path between two evacuated components. It, too, is evacuated.

In a typical implementation, the actuation system employs a standard flat can lid with a circular hole, eliminating the need for any specially designed lid (with complex contours), requires only that a portion of the actuation mechanism be attached to the absorber can lid, and the other portion be attached to the beverage can base, which has a matching central hole, so that they mate simply.

Implementations of a self-cooling can are described herein with a space between the upper and lower portions of the self-cooling can provided to accommodate the actuating system disclosed herein. Those implementations are for when the absorber can has a flat, or at least substantially flat, upper lid/surface. Alternatively, an absorber lid may be provided with a simple depression in the center to reduce the space between the upper and lower portions.

The rigid annular bodies as well as other portions of and the self-cooling can assembly overall, can be manufactured in a variety of ways. In one exemplary implementation, each rigid annular body is formed as a molded plastic ring. In some implementations, the final assembly of the competed refrigerator requires cementing the cutter mounting ring with the cutter assembled into the base of the filled beverage can, cementing the component with the ring gear and O-ring to the absorber can lid, placing the two in a vacuum chamber (which may be implemented and schematically envisioned as a sealed box (with an air tight closeable door) and a suction unit (e.g., vacuum pump, air ejector, etc.), then pressing the two together while returning the assembly to atmospheric pressure. In some implementations, the upper and lower portions may be held together (with the actuator assembly therebetween) by atmospheric pressure in this regard. Experience has shown that the two portions may be held together firmly in this manner for many years. The level of vacuum produced in the vacuum chamber can vary. In various implementations, however, the vacuum may be a low vacuum (e.g., (31 kPa to 110 kPa) to 100 Pa), a medium vacuum (e.g., <100 Pa to 0.1 Pa), a high vacuum (e.g., <0.1 Pa to $1\times10^{-6}$ Pa), an ultra-high vacuum (e.g., $<1\times10^{-6}$ Pa to $1\times10^{-9}$ Pa), or an extreme high vacuum (e.g., below $1\times10^{-9}$ Pa). Other ranges of vacuum are possible as well.

A number of embodiments of the invention have been described. Nevertheless, it will be understood that various modifications may be made without departing from the spirit and scope of the invention.

For example, the size and shape, relative and absolute, of the self-cooling beverage can and its components and subcomponents may vary considerably. For example, the rigid annular bodies and the cutter can have other configurations. The serrated edges can be any kind of cutting edge or other solid formation that is able to tear into or otherwise compromise the frangible seals. The frangible seals can be any one of a variety of different materials and sizes, as can the holes they cover. The O-ring can be any one of a variety of different O-ring materials and may be lubricated to facilitate sliding between the upper and lower portions of the can. The cutter support can have different configurations. For example, it need not be annular.

As mentioned herein, in some implementations, the two portions (upper and lower) may be held together by a vacuum, achieved by assembling the two portions together in a vacuum chamber. In an exemplary implementation, an injection molded rigid annular body for the drive gear assembly is a single injection molded cap which fits tightly over the top of the lower portion (e.g., absorber can). This cap may be designed to fit the seam of the lower can and includes the drive gear and a recess to take the O-ring seal all in one molding. This lines up with the formed base of the beverage can. The O-ring, in those instances, forms a sliding vacuum seal (i.e., a seal to maintain a vacuum between the two portions while allowing the two portions to slide (or twist) relative to one another. While this may be designed as a tight fit on the can rim it may, in some implementations, need sticking with an adhesive or sealant to prevent it all from slipping as the parts are rotated. In instances where the upper and lower portions of the can are held together by virtue of a vacuum in the space that accommodates the cutter, no separate adhesive or structural features may be provided to hold the two portions together in an axial direction.

The self-cooling can is described herein as containing a beverage to be cooled. However, the self-cooling can may be utilized to cool virtually any kind of coolable substance (e.g., any liquid, etc.). The refrigerant used can vary. The desiccant used can vary. The heat sink material (typically, a meltable solid material) can vary.

The upper portion and lower portion of the assembly are described as being can-shaped, but these can take on other shapes. Moreover, one or more of the internal compartments (e.g., the evaporator compartment, the beverage compartment, the desiccant compartment, and/or the heat sink compartment) can vary from the specific configurations disclosed herein. For example, in some implementations, the heat sink compartment may be formed by a string or collection of sealed pouches containing a heat sink material, with the desiccant filled loosely around them in a desiccant chamber.

The cutter may be provided with teeth on either or both faces so that the direction of rotation of the two cans with respect to each other is irrelevant. The teeth can form virtually any kind of cutting shape (e.g., saw tooth, etc.).

The notch and cutter could be reversed—with the notch being on the pinion gear and the projection being on the surface of the support element.

It should be understood that any relative terminology used herein, such as "upper", "lower", "above", "below", "front", "rear", etc. is solely intended to clearly describe the particular implementations being discussed and is not intended to limit the scope of what is described here to require particular positions and/or orientations. Moreover, terminology like "horizontal," "vertical," and the like, assume the self-cooling can is in a normal upright orientation. If the device is not sitting with its base on a horizontal support surface, then the surfaces, subcomponents, etc. described as being "horizontal," "vertical," or the like, would not be. These terms, therefore, should be considered as describing particular illustrated implementations and, unless otherwise indicated or claims, not otherwise limiting to the scope of the present application. Unless otherwise indicated and/or claimed, none of the relative terminology used herein should be construed to limit the scope of the present application. Additionally, terms such as substantially, and similar words, may be used herein. Unless otherwise indicated, substantially, and similar words, should be construed broadly to mean completely and almost completely (e.g., for a measurable quantity this might mean, for example (and without limitation), completely, 99% or more, 95% or more, 90% or more, 85% or more, 80% or more, etc.).

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations and/or processes are disclosed herein as occurring in a particular order, this should not be understood as requiring that such operations be performed in the particular order shown or in sequential order, or that all indicated operations be performed in order to achieve desirable results. In certain circumstances, multitasking or parallel processing may be advantageous.

Other implementations are within the scope of the claims.

What is claimed is:

1. A self-cooling container for cooling a liquid, the self-cooling container comprising:

a first portion comprising:

an internal compartment containing the liquid to be cooled;

an internal evaporator unit containing a refrigerant; and a first frangible seal that extends across and seals off the evaporator unit;

a second portion comprising:

an internal desiccant chamber containing a desiccant; and a second frangible seal that extends across and seals off the desiccant chamber, wherein the first portion is configured to rotate about an axis of the self-cooling container relative to the second portion;

an actuator assembly between the first portion and the second portion of the self-cooling container, wherein the actuator assembly comprises:

a cutter assembly coupled to the first portion of the self-cooling container, wherein the cutter assembly comprises:

a cutter support;

a rotatable axle coupled to the cutter support;

a cutter coupled to the rotatable axle; and a pinion gear coupled to the rotatable axle; and a drive gear assembly coupled to the second portion of the self-cooling container, wherein the drive gear assembly comprises:

a housing; and a ring gear supported by the housing, wherein the pinion gear on the cutter assembly is mated to the ring gear of the drive gear assembly.

2. The self-cooling container of claim 1, wherein rotating the first portion about the axis of the self-cooling container relative to the second portion causes the ring gear to rotate about the axis of the self-cooling container relative to the cutter assembly, and wherein rotating the ring gear about the axis of the self-cooling container relative to the cutter assembly causes the pinion gear to rotate about an axis of the axle.

3. The self-cooling container of claim 2, wherein rotating the pinion gear about the axis of the axle causes the cutter to rotate about the axis of the axle.

4. The self-cooling container of claim 3, wherein the cutter is configured relative to the first and second frangible seals such that rotating the cutter about the axis of the axle causes the cutter to cut into and tear through the first and second frangible seals.

5. The self-cooling container of claim 4, wherein cutting into and tearing through the first and second frangible seals establishes a fluid flow path between the internal evaporator unit and the internal desiccant chamber.

6. The self-cooling container of claim 5, wherein establishing the fluid flow path enables the refrigerant in the internal evaporator unit to evaporate and travel to the internal desiccant chamber.

7. The self-cooling container of claim 6, wherein the second portion of the self-cooling container further comprises an internal heat sink to remove heat from the desiccant.

8. The self-cooling container of claim 1, further comprising:

a notch formed in a surface of the housing facing a side surface of the pinion gear;

a projection that extends out from the side surface of the pinion gear;

a boss near an end of the axle opposite from the pinion gear; and an axial spring between the boss and an inner surface of the housing.

9. The self-cooling container of claim 8, wherein, the projection is configured to fit into the notch and the axial spring is configured to push against the boss and against the inner surface of the housing to urge the pinion gear toward the surface of the housing such that the projection, when aligned with the notch is urged into engagement with the notch.

10. The self-cooling container of claim 9, wherein each of the notch and the projection is V-shaped.

11. The self-cooling container of claim 9, wherein the cutter is maintained in a position that is away from the first and second frangible seals when the notch is in engagement with the notch.

12. The self-cooling container of claim 1, further comprising:

an O-ring positioned at, and configured to seal, an interface between a first surface of the upper portion of the self-cooling container and a second surface of the drive gear assembly.

13. The self-cooling container of claim 12, wherein the upper portion of the self-cooling container is secured to the lower portion of the self-cooling container by a vacuum pressure condition in a space between the upper portion of the self-cooling container and the lower portion of the self-cooling container within the seal provided by the O-ring.

14. A self-cooling container for cooling a liquid, the self-cooling container comprising:

a first portion comprising a first frangible seal that extends across and seals off an internal evaporator unit containing a refrigerant;

a second portion comprising a second frangible seal that extends across and seals off a desiccant chamber containing a desiccant, wherein the first portion is configured to rotate about an axis of the self-cooling container relative to the second portion;

an actuator assembly between the first portion and the second portion of the self-cooling container, wherein the actuator assembly comprises:

a cutter assembly coupled to the first portion of the self-cooling container, wherein the cutter assembly comprises a cutter coupled to a rotatable axle and a pinion gear coupled to the rotatable axle; and a drive gear assembly coupled to the second portion of the self-cooling container, wherein the drive gear assembly comprises a ring gear supported by a housing, wherein the pinion gear on the cutter assembly is mated to the ring gear of the drive gear assembly.

15. A method of manufacturing a self-cooling container for cooling a liquid, the method comprising:

providing a first portion of the self-cooling container, wherein the first portion comprises:

an internal compartment containing the liquid to be cooled;

an internal evaporator unit containing a refrigerant; and a first frangible seal that extends across and seals off the evaporator unit;

providing a second portion of the self-cooling container, the second portion comprising:

an internal desiccant chamber containing a desiccant; and a second frangible seal that extends across and seals off the desiccant chamber, providing a cutter assembly for the self-cooling container, wherein the cutter assembly comprises:

a cutter support;

a rotatable assembly coupled to the cutter support, wherein the rotatable assembly comprises:

a rotatable axle;

a cutter coupled to the rotatable axle; and a pinion gear coupled to the rotatable axle; and providing a drive gear assembly for the self-cooling container, wherein the drive gear assembly comprises:

a housing; and a ring gear supported by the housing, attaching the cutter support of the cutter assembly to the first portion of the self-cooling container;

attaching the housing of the drive gear assembly to the second portion of the self-cooling container;

placing the first portion of the self-cooling container with the attached cutter support in a vacuum chamber;

placing the second portion of the self-cooling container with the attached drive gear assembly in the vacuum chamber;

establishing a vacuum environment within the vacuum chamber;

pressing the first portion of the self-cooling container with the attached cutter support against the second portion of the self-cooling container with the attached drive gear assembly, with an O-ring therebetween, within the vacuum environment so that the pinion gear of the cutter assembly engages the ring gear of the drive gear assembly; and removing the first portion of the self-cooling container with the attached cutter support and the second portion of the self-cooling container with the attached drive gear assembly, with the O-ring therebetween, from the vacuum environment, wherein the first portion of the self-cooling container with the attached cutter support remains connected to the second portion of the self-cooling container with the attached drive gear assembly after being removed from the vacuum environment by virtue of a low pressure environment persisting in an internal space between the first portion of the self-cooling container and the second portion of the self-cooling container after removal from the vacuum environment.

16. The method of claim 15, wherein the cutter assembly further comprises:

a notch formed in a surface of the housing facing a side surface of the pinion gear;

a projection that extends out from the side surface of the pinion gear;

a boss near an end of the rotatable axle opposite from the pinion gear; and an axial spring between the boss and an inner surface of the housing, the method further comprising:

maintaining the rotatable assembly of the cutter assembly in a fixed configuration at least during the method of manufacturing by:

fitting the projection into the notch;

configuring the axial spring to push against the boss and against the inner surface of the housing to urge the pinion gear toward the surface of the housing such that the projection remains urged into engagement with the notch.

* * * * *